United States Patent [19]

Akkerman

[11] Patent Number: 4,475,599

[45] Date of Patent: Oct. 9, 1984

[54] VALVE FOR SUBTERRANEAN WELLS

[75] Inventor: Neil H. Akkerman, Kingwood, Tex.

[73] Assignee: Baker International Corporation, Orange, Calif.

[21] Appl. No.: 259,767

[22] Filed: May 1, 1981 (Under 37 CFR 1.47)

[51] Int. Cl.[3] ..... E21B 43/12

[52] U.S. Cl. ..... 166/323; 137/630.14; 166/325; 166/374

[58] Field of Search ..... 166/323, 373, 374, 321, 166/319, 325; 137/630.14, 630.15

[56] References Cited

U.S. PATENT DOCUMENTS

| | | | |
|---|---|---|---|
| 2,812,821 | 11/1957 | Nelson | 166/325 |
| 2,846,014 | 8/1958 | Daffin et al. | 166/237 |
| 2,979,072 | 4/1961 | Webster | 137/630.14 |
| 3,051,246 | 8/1962 | Clark, Jr. | 166/327 |
| 3,078,923 | 2/1963 | Tausch | 166/324 |
| 3,971,438 | 7/1976 | Crowe | 166/224 A |
| 4,160,484 | 7/1979 | Watkins | 166/323 |
| 4,252,143 | 2/1981 | Fredd | 166/323 |

FOREIGN PATENT DOCUMENTS

| | | | |
|---|---|---|---|
| 2015065 | 10/1970 | Fed. Rep. of Germany | 137/630.15 |

*Primary Examiner*—William F. Pate, III

*Attorney, Agent, or Firm*—Norvell & Associates

[57] ABSTRACT

The invention relates to an improved subterranean well safety valve wherein an annular actuator is moved downwardly by applied fluid pressure to effect the opening movement of a valve head of a valve relative to an annular valve seat. The initial downward movement of the actuator effects the displacement of a valve stem which extends through a restricted aperture in the valve head, moving a ball valve segment on the valve stem from a seat in the aperture, thus permitting the bleeding of any fluid pressure differential existing on the lower side of the valve head relative to the upper side and reducing the amount of force required to move the valve to its open position. Additionally, in one embodiment, a locking sleeve is slidably mounted within the shiftable annular actuator and such sleeve is operable by an auxiliary tool to effect the radial shifting of locking elements carried by the actuator into locking engagement with the valve housing to achieve a temporary locking of the valve in an open position. The travel of the locking sleeve relative to the valve housing in a reverse direction is limited by a shearable pin so that reverse forcible movement of the locking sleeve will shear the pin and effect a permanent locking of the radially expansible locking segments carried by the actuating sleeve to the valve housing, thus permanently locking the valve in an open position.

20 Claims, 18 Drawing Figures

VALVE FOR SUBTERRANEAN WELLS

BACKGROUND OF THE INVENTION

1. FIELD OF THE INVENTION: The invention is directed to improvements in valves employed in subterranean wells, for example, safety valves, such improvements being directed to providing pressure equalization between the upper and lower faces of the valve head employed to engage the valve seat to facilitate opening same, and mechanism for selectively effecting the temporary locking of the valve in an open position or converting the temporarily locked open valve to a condition where it is permanently locked in its open position.

2. DESCRIPTION OF THE PRIOR ART: Valve mechanisms have been employed in subterranean wells for the primary purpose of effecting a reliable, positive closure of the bore of a production tubing string in the event of any emergency. The actual valving elements of heretofore known valves have comprised ball valves, flapper valves, poppet valves and axially shiftable block elements. Regardless of the type of valving element employed, there has been a problem of effecting the reliable opening of such a valve whenever a significant pressure differential existed between the lower surface of the valve element and the upper surface. There is, therefore, a need for a pressure equalizing mechanism which accomplishes the equalization of such pressure differential as an automatic consequence of an initial movement of the actuator employed to open the valve.

A common form of actuator for such a valve is an annular sleeve which is driven downwardly through the imposition of a controlled fluid pressure supplied from the top of the well head. There are often occasions in conducting testing of a well or replacement of down hole elements of the tubing string or other conduit where it is desirable to insure that the valve is mechanically locked in an open position and is not dependent upon maintaining its open position solely through the continued application of the control pressure.

Additionally, if it is necessary to remove the conduit carrying the valve from the well, it is very desirable that the valve be permanently locked in its open position during the removal operation so as to insure the ready drainage of any fluid trapped in the tubing string as the string is removed from the well.

SUMMARY OF THE INVENTION

This invention provides a number of improved features which are applicable to any of the well known types of valves, and particularly safety valves, employed in subterranean wells.

In order to effect the opening of a valve in a subterranean well with minimal force requirements, it is desirable that any pressure differential existing between the lower and upper faces of the valve be equalized prior to effecting actual displacement of the valve head element of the valve relative to the valve seat. Throughout this application, the term "valve head" will be employed to designate the shiftable element of any one of a number of well known types of valves. Thus, as specifically shown in the drawings, it may constitute a flapper valve, but it may also constitute a ball or an axially movable member.

The valve head element is provided with an aperture extending from its bottom surface to its upper surface and a valve stem is slidably mounted in such aperture. Means are provided on the lower end of the valve stem for effecting a sealed engagement of the aperture, thus preserving the integrity of the valve. The upper end of the valve stem is provided with an enlarged portion which extends into the path of movement of the actuator commonly employed in operating such valves in subterranean environments.

For example, an annular sleeve which is movable downwardly under the influence of fluid pressure supplied from the top of the well may have its bottom end surface contacting the enlarged portion of the valve stem to effect an opening of the aperture through the valve to bleed the pressure below the valve through the aperture and thus substantially equalize the pressure operating on the lower and upper surfaces of the valve. When such equalization is achieved, the actuator can be moved further with minimal force to effect the actual opening of the valve.

Once the valve has been opened by the fluid pressure induced movement of the annular actuator, it is sometimes desirable to effect a temporary mechanical locking of the safety valve in its open position. In accordance with this invention, such temporary mechanical locking is achieved by providing the annular actuator with a peripheral array of radially expandable locking segments which are normally resiliently biased to an inwardly retracted position by a peripheral biasing member. A peripheral locking shoulder is provided in the valve housing below which the locking segments may be engaged by radial expansion. Such radial expansion is effected by a locking sleeve slidably mounted within the bore of the annular actuator for limited axial movement relative thereto and having conventional means thereon for connecting to an auxiliarly conduit such as a wire line.

The locking sleeve is also provided with an external peripheral recess within which the inner ends of the locking segments extend in their radially retracted position. A bias is provided, together with shearable means traversing a slot in the actuator, for securing the locking sleeve in the position wherein the locking segments carried by the annular actuator are radially aligned with the peripheral recess of the locking sleeve. Accordingly, once the locking segments are radially aligned beneath the locking shoulder in the housing, the auxiliary conduit is operably communicated to the locking sleeve and the locking sleeve is forced longitudinally by manipulation of the auxiliary conduit to effect the outward camming of the locking segments into locking engagement with the downwardly facing peripheral shoulder provided in the valve housing. The subsequent release of control pressure on the annular actuator then does not affect the position of the annular actuator, since it is positively locked in its downward position through the engagement of the radially expanded locking segments beneath the housing shoulder.

Such temporary locking of the valve in its open position may be conveniently released by merely releasing the force applied through the auxiliary conduit on the locking sleeve, permitting the locking sleeve to be returned by its biasing means to its normal position wherein its peripheral recess is aligned with the inner ends of the radially expanded locking segments. Control pressure is then applied to the annular actuator to force it longitudinally a slight degree, which effects the release of the locking segments from the housing shoulder and permits them to retract inwardly under the influence of the peripheral inward biasing means. The auxiliary conduit may then be disengaged from the locking sleeve and the valve placed in normal operation.

In some instances, it may be desirable to convert the temporary locking of the valve in its open position to a permanent lock. In such event, the auxiliary conduit is manipulated to exert sufficient axial force on the locking sleeve to effect the shearing of the shearable means and thus cause the recess in the locking sleeve, which normally receives the inner ends of the outwardly expanded locking segments, to move longitudinally to a position where it is no longer aligned with such segments. Thus, the segments are permanently locked by the non-recessed wall of the locking sleeve in their outwardly expanded position underneath the downwardly facing shoulder provided in the valve housing, and the valve is permanently locked in its open position.

BRIEF DESCRIPTION OF THE DRAWINGS

FIG. 6A shows the position of these elements in the normal valve open position. FIG. 6B illustrates the positions of these elements in the temporary locked open position. FIG. 6C illustrates the position of these elements in the permanently locked open position of the safety valve.

FIG. 7A shows the valve in its completely closed position and FIG. 7B shows the valve with the pressure equalizing valve open to effect the equalization of fluid pressure above and below the valve.

DESCRIPTION OF THE PREFERRED EMBODIMENTS

Figure 1A:
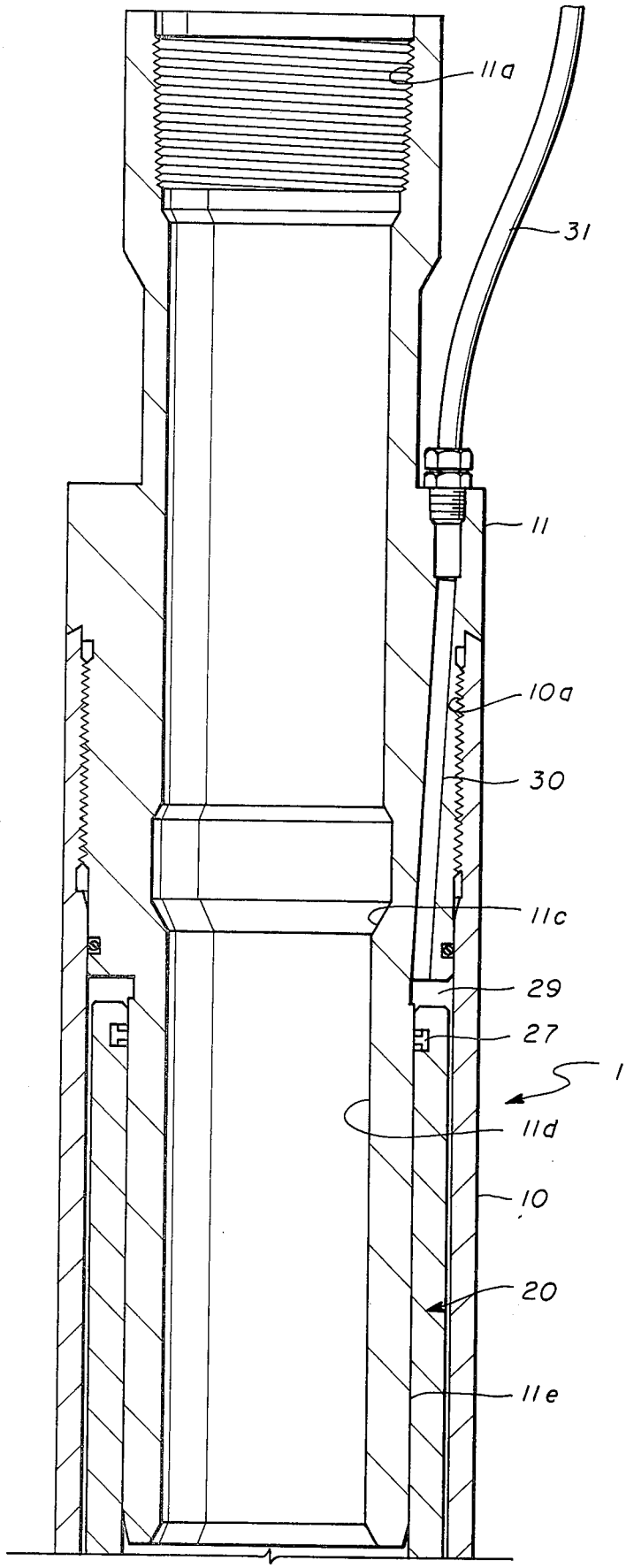
FIGS. 1A through 1D are respectively successive vertical sectional views of a safety valve incorporating the improvements of this invention with the elements of the valve shown in closed position, FIGS. 1B, 1C and 1D respectively constitute downward continuations of FIGS. 1A, 1B and 1C.
Figure 1B:
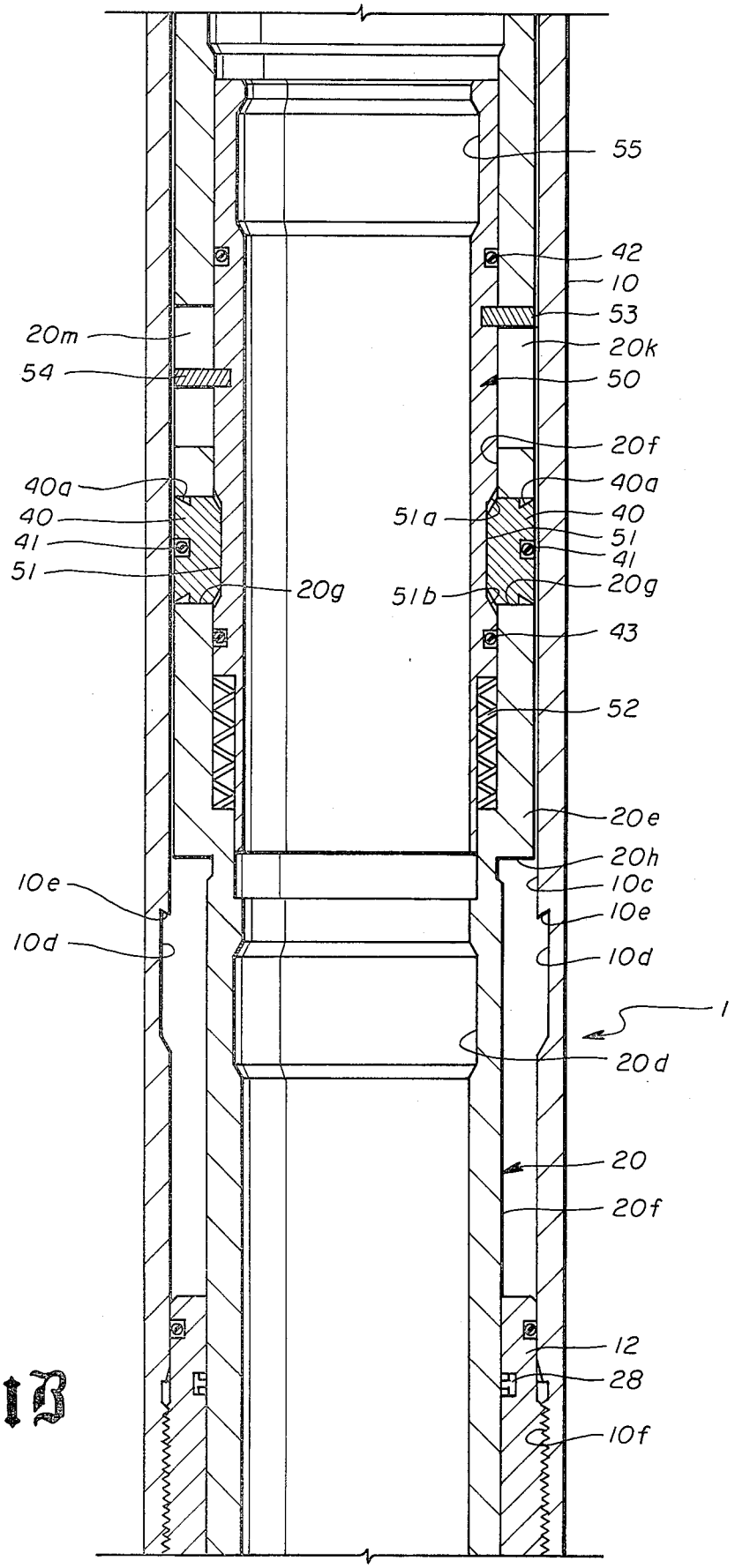
Figure 1C:
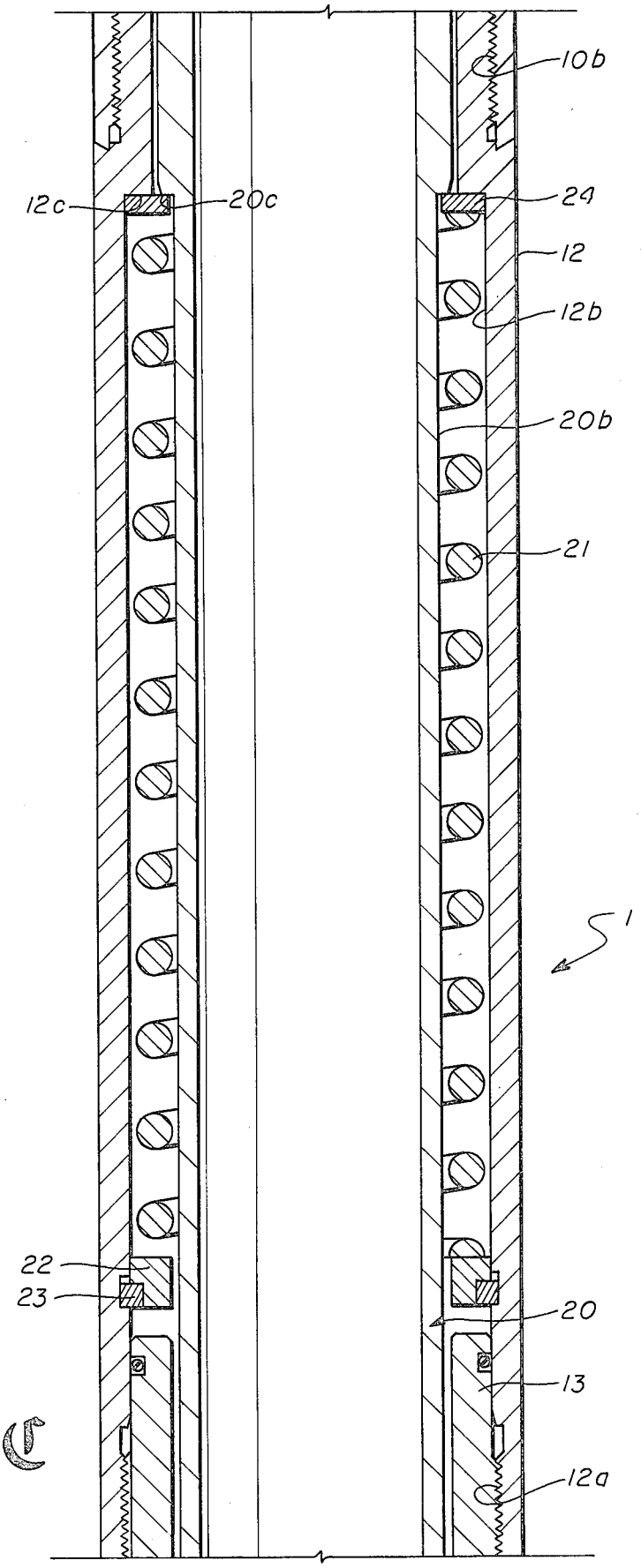

Referring to the drawings, the numeral 1 indicates generally a valve, such as a safety valve, embodying all of the improved features of this invention. The valve 1 includes an upper sleeve-like housing 10 which is threadably connected by internal threads 10*a* to the external threads of a top sub 11 which in turn has its top end internally threaded at 11*a* to permit the mounting of the sub 11 on the end of a production string or other conduit. Top sub 11 is provided with a landing shoulder 11*c*, which, together with a lower seal bore 11*d* in the bottom sub 11, define means for landing and sealing an auxiliary conduit tool. The lower end of the upper housing 10 is internally threaded as indicated at 10*f* to engage the external threads provided on the upper end of an intermediate sleeve-like housing 12. The lower end of intermediate housing 12 is internally threaded as indicated at 12*a* for connection to the top threaded end of a valve housing 13. The bottom end of valve housing 13 is internally threaded as indicated at 13*a* for connection to a bottom sub 14 to which the remainder of the production string may be conventionally attached by external threads 14*a* provided on the bottom end of the bottom sub.

Within the valve housing 13, there is defined a laterally enlarged chamber 13*c* within which any conventional type of valve head may be mounted. In the illustrated embodiment, the safety valve comprises a flapper-type valve having a main body portion 15 which is pivotally mounted on a horizontal pin 16 suitably mounted in the walls of the valve housing 13 and engaged by a pair of pivot brackets 15*a* provided on one lateral side of the valve body 15.

An annular valve seat is mounted in the valve housing 13 comprising an inverted L-shaped ring 17 of elastomeric material which is retained in a correspondingly shaped recess formed in the interior cylindrical wall of the valve housing 13 and retained therein by a retainer sleeve 18. The bottom surface 17*a* of the annular seal 17 engages the perimeter of the disc-shaped top surface 15*b* of flapper valve body element 15. A torsion spring 19 is provided having a coil portion 19*a* wrapped around pivot pin 16 and end portions 19*b* and 19*c* respectively engaging the bottom surface 15*c* of the valve body 15 and the side wall of the valve housing 13 so as to impart an upward bias to the body element 15 holding it in sealing engagement with the end face 17*a* of the elastomeric seal 17. Of course, if the down hole fluid pressure in the well exceeds the fluid pressure existing above the valve body 15, this force is also applied to the valve body in addition to the spring force to maintain the valve body in sealed relationship with elastomeric seal 17, thus closing the fluid passage for production fluid through the valve housing 13.

The flapper valve body element 15 may be shifted to an open position by longitudinal movement of an actuator which, in the illustrated embodiment, comprises an elongated sleeve 20 having its bottom end 20*a* disposed in spaced relationship above the top face 15*b* of the flapper valve body element 15. The lower portion 20b of the actuator sleeve 20 is of reduced external diameter so as to provide an annular space between such lower portion and the internal bore 12*b* of the intermediate housing for the mounting of a biasing spring 21. The bottom end of spring 21 abuts an annular spring anchor 22 which is held in fixed position relative to the intermediate housing 12 by a split ring 23 which engages an appropriate recess in intermediate housing 12 at a point just above the end of the valve housing 13. The upper end of spring 21 abuts a washer 24 which is engaged by a downwardly facing shoulder 12*c* formed in the intermediate housing 12 when the actuating sleeve 20 is in its inoperative position and, in all lower positions of sleeve 20, is abutting a downwardly facing shoulder 20*c* formed at the upper end of the reduced diameter portion 20*b* of the actuating sleeve 20. Adjacent the top end of the actuating sleeve 20 there is provided a conventional auxiliary conduit tool receiving recess 20*d* which may be employed to effect movement of the actuating sleeve 20 in the event of failure of the hydraulic system that is normally utilized for controlling its movements. Above the recess 20*d* the actuating sleeve 20 is radially enlarged as indicated at 20*e* so as to be freely slidable within the internal bore surface 10*b* provided within the upper housing 10. At a point below the normal or inoperative position of the actuating sleeve 20, the bore 10*c* of the upper housing 10 is provided with an annular recess 10*d* which has an inclined downwardly facing surface 10*e* which functions as a locking surface.

The top sub 11 is provided with a reduced diameter annular extension 11*e* which fits snugly within the bore of the upper portion of the actuating sleeve 20. A T-seal 27 provides a fluid seal between such surfaces. A second T-seal 28 is provided in the top end of the intermediate housing 12 and provides a sealing engagement with the cylindrical surface 20*f* of the tubular housing 20. There is thus defined between the T-seals 27 and 28 a fluid pressure chamber 29 within which the upper end of the actuating sleeve 20 is reciprocally mounted and functions as a piston.

Control pressure is supplied to chamber 29 through a vertical extending passage 30 provided in the outboard portion of the top sub 11 and connected to a conduit 31 extending to the top of the well. The amount of force imposed by the controlled pressure fluid on the actuating sleeve is determined by the difference in the effective areas of the annular top end face of the actuating sleeve 20 and the downwardly facing shoulder 20*h* formed at the juncture of the enlarged sleeve portion 20*e* and lower portions of sleeve 20. These areas are designed so as to result in a net downward force being imposed on the actuating sleeve 20 whenever the pressurized control fluid is supplied to chamber 29.

Obviously, since the actuating sleeve 20 has to open the safety valve by moving body element 15 downwardly away from the elastomeric seal 17, the amount of force required would be substantially increased if any fluid differential existed between the bottom and top faces of the valve body unit 15. To eliminate such fluid pressure differential prior to effecting the actual opening movement of the valve body element 15, a pressure equalizing mechanism is provided which essentially comprises an aperture 15*d* extending through valve body element 15 and having enlarged counterbored portions 15*e* and 15*f* respectively at its lower and upper ends. An inverted cup-shaped valve seat member 32 is inserted in the lower counterbore 15*e* and defines a downwardly facing spherical segment sealing surface 32*a* which is engageable by a spherical segment valve element 33 carried on the end of a valve stem 34 mounted in the aperture 15*d*. The upper end of the valve stem 34 extends into the upper counterbore 15*f* of the aperture 15*d* and is provided with a substantial diametrically enlarged portion 35.

Figure 1D:
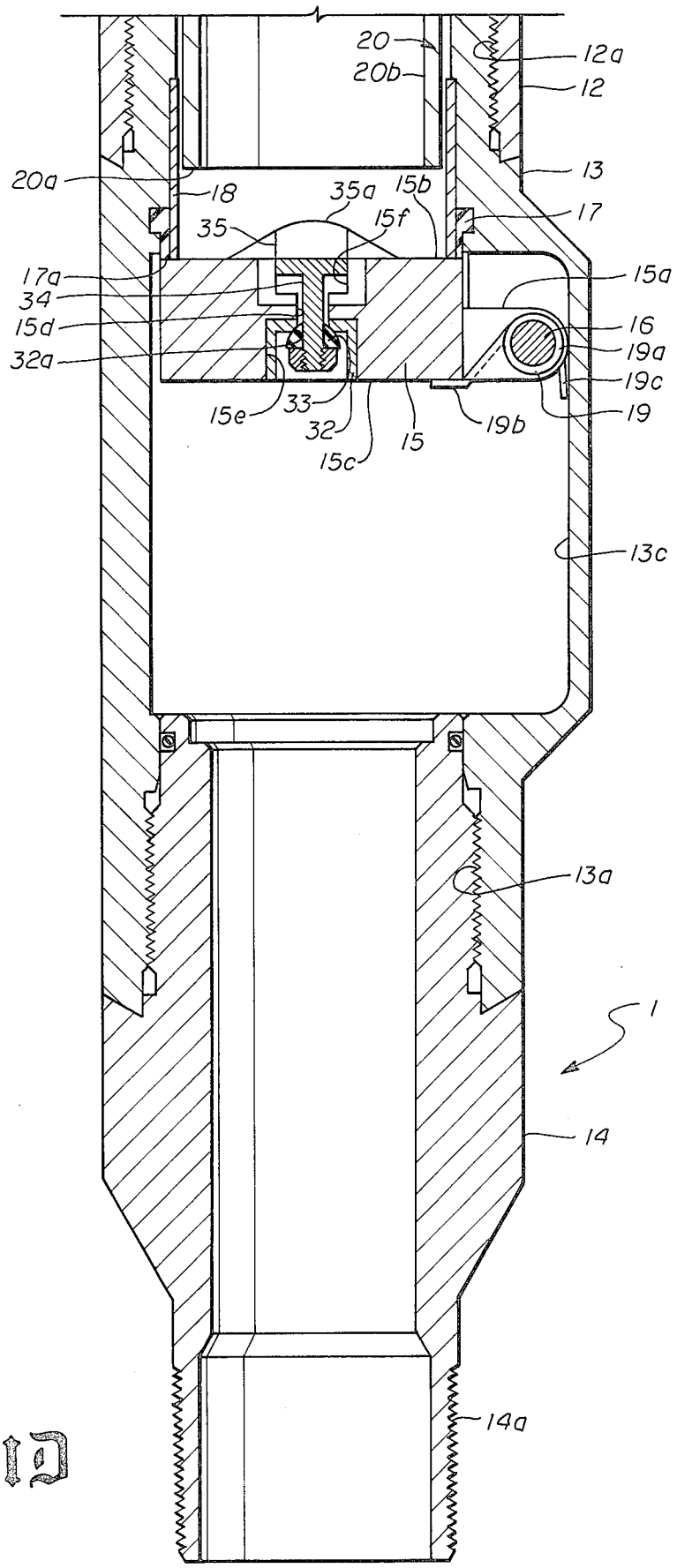
Figure 2A:
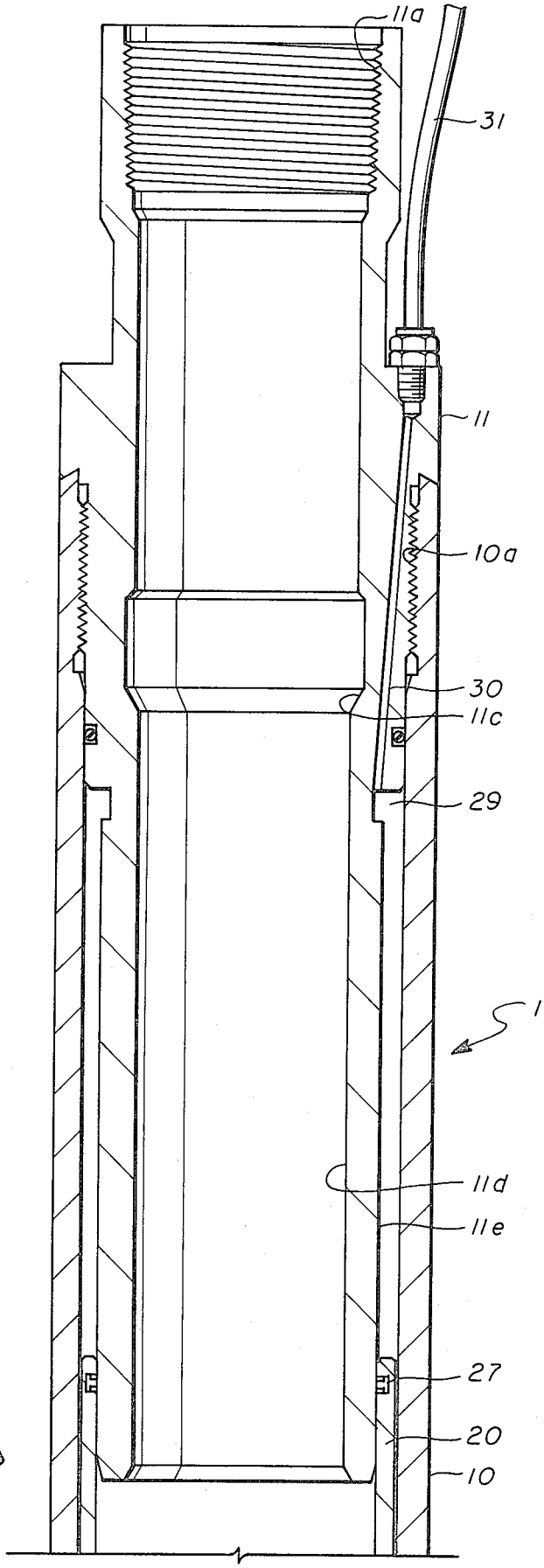
FIGS. 2A through 2D are views similar to FIGS. 1A through 1D but show the safety valve incorporating improvements of this invention in its normal, hydraulically opened position.
Figure 2B:
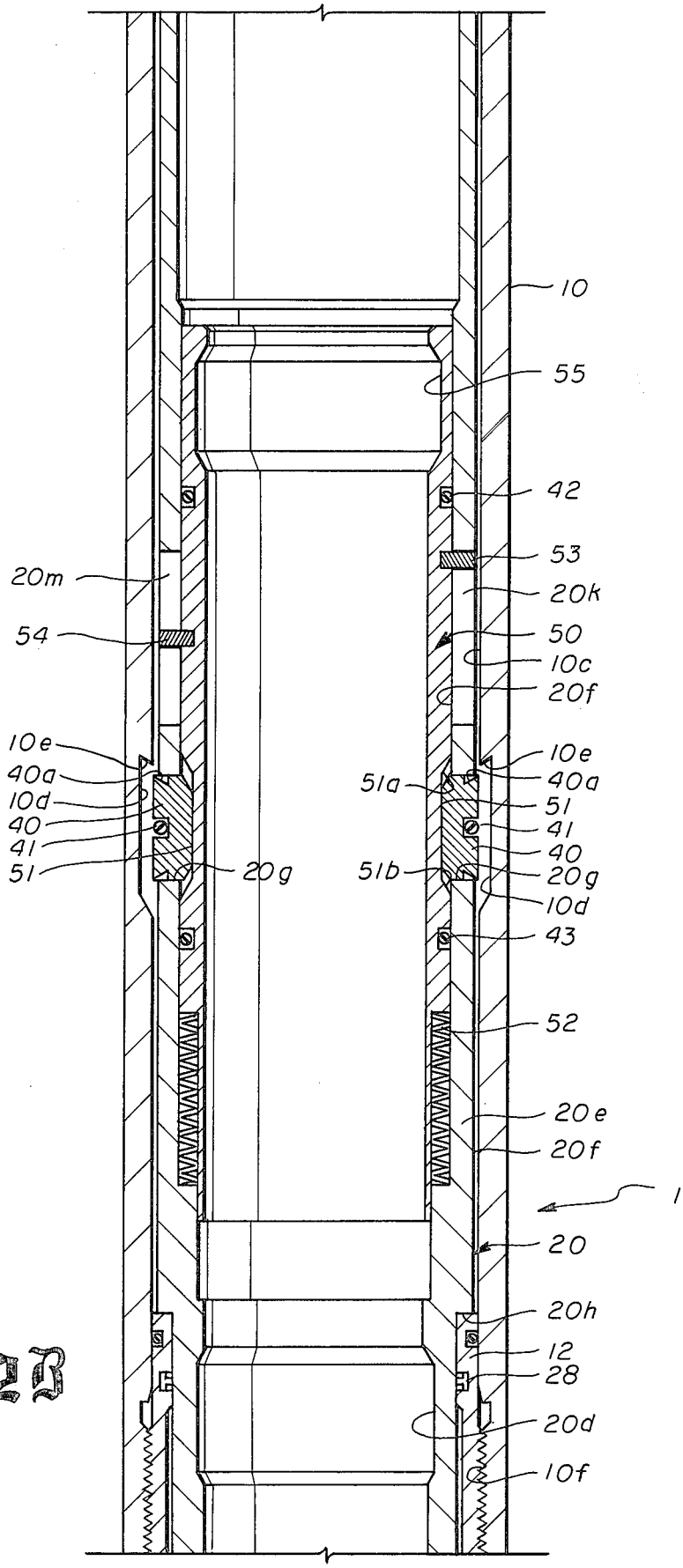
Figure 2C:
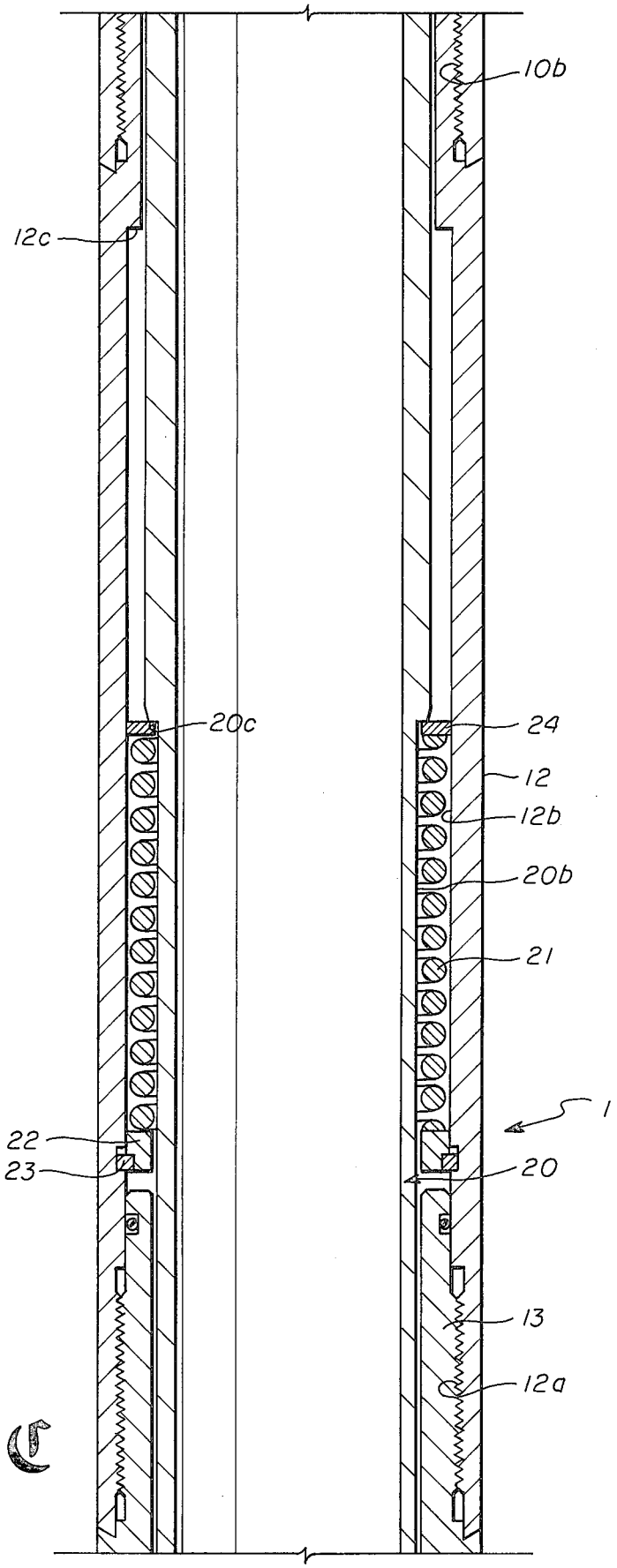
Figure 2D:
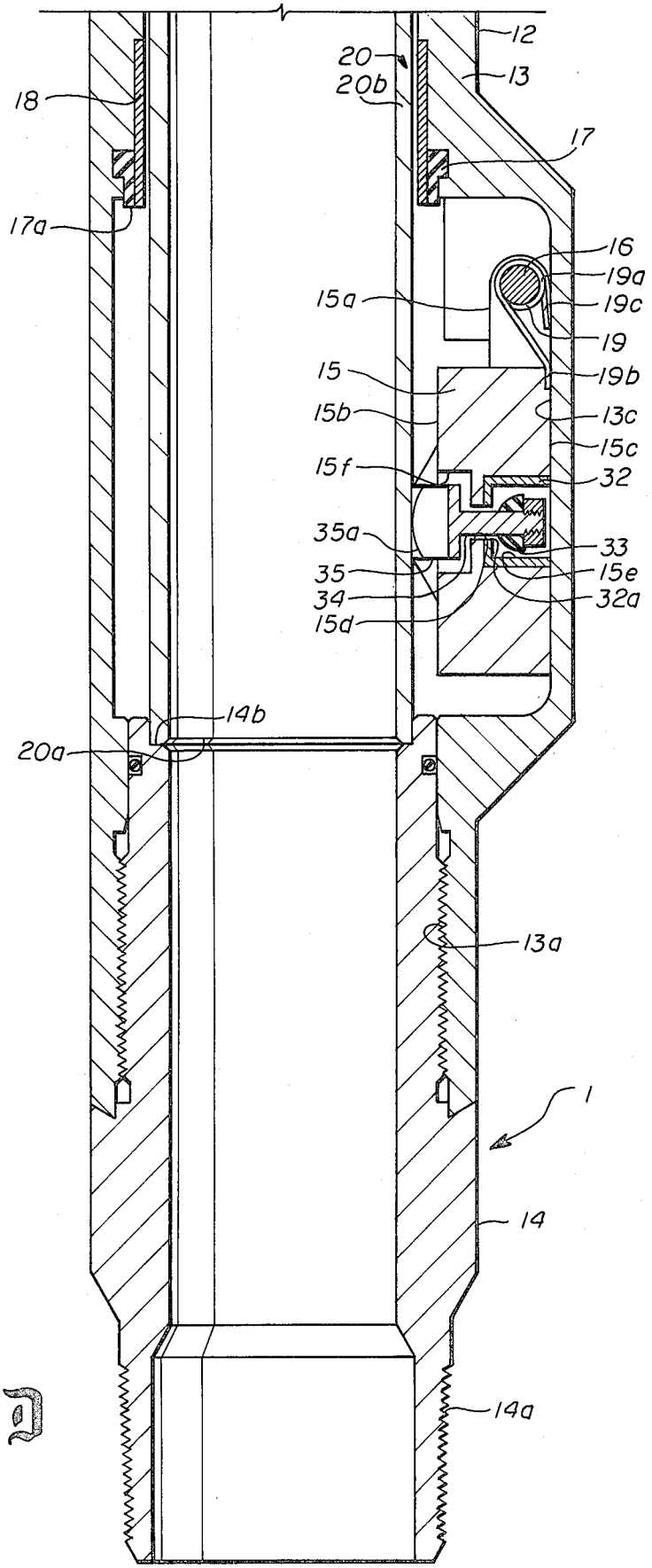
Figure 7A:
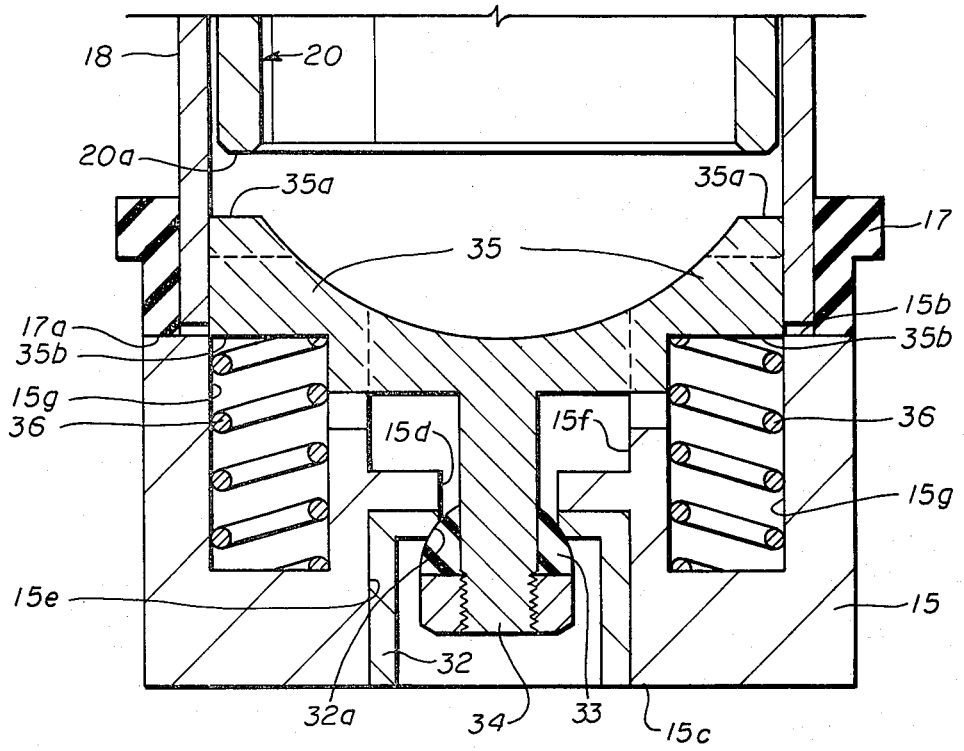
FIGS. 7A and 7B are respectively enlarged scale vertical sectional views taken on plane 7—7 of FIG. 1D.
Figure 7B:
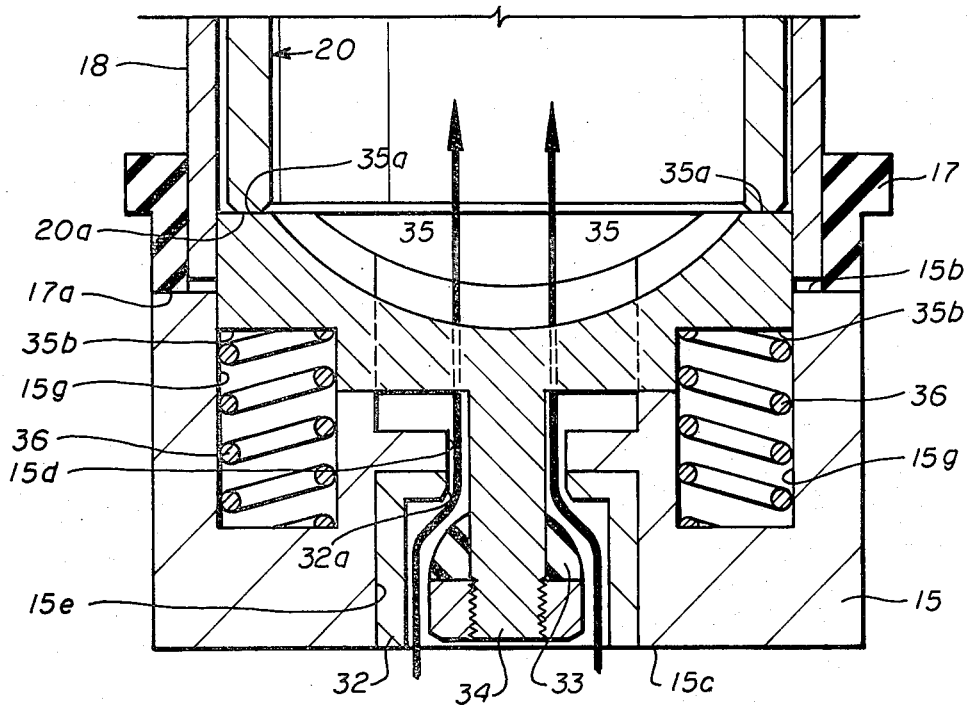

As best shown in FIGS. 7A and 7B, the enlarged portion 35 of the valve stem 34 extends laterally across the full diameter of the retaining sleeve 18 and, at its outer ends, is provided with a generally dome-shaped or convex configuration 35*a* which is best shown in FIG. 1D. A pair of biasing springs 36 are respectively mounted in cooperating opposed recesses 35*b* and 15*g* provided in the expanded portion 35 of the valve stem 34 and the body element 15. The springs 36 insure that the ball-valve segment 33 is maintained in sealing engagement with the annular ball seat surface 32*a* as is illustrated in FIG. 7A. When, however, the actuating sleeve 20 is moved downwardly, the first consequence of its movement is to effect a depression of the laterally expanded portion 35 of the valve stem 34 and hence open a flow passage between the spherical segment ball 33 and the annular ball seat 32*a* to permit any fluid pressure differential existing across the valve body unit 15 to be dissipated through the aperture 15*d* as indicated by the flow arrows in FIG. 7B. Further downward movement of the actuating sleeve 20 will then effect the bodily displacement of the valve body element 15 from engagement with the end face of the annular elastomeric seal 17 and initiate the opening movement of the safety valve. The dome-shaped end portions 35*a* of the expanded portion 35 effect a rolling-sliding action on the bottom end face 20*a* of the actuating sleeve 20 as such opening motion progresses. The flapper valve body element 15 eventually comes to rest in a vertical position within the valve housing 13 as indicated in FIG. 2D, and the end 20*a* of actuating sleeve 20 abuts a shoulder 14*b* in bottom sub 14.

The downward movement of the actuating sleeve 20 is, of course, resiliently opposed by compression of the spring 21 and whenever the control pressure is reduced in the chamber 29, the actuating sleeve 21 will normally retract to its inoperative position shown in FIGS. 1A–1D and permit the flapper valve body element 15 to again move into sealing engagement with the elastomeric seal 17, under the bias of torsion spring 19.

The described mechanism for effecting equalization of any pressure differential across the flapper valve element 15 will be equally applicable to any type of valving arrangement employing a vertically movable valve head. The essential feature of the invention is that the initial opening movement of the actuating sleeve effects only the opening of the small bleeding aperture 15*d* provided through the valve body 15, and thus effects the equalization of pressure before any bodily movement of the valve body unit 15 is required. Thus, the actuating force for opening a valve constructed in accordance with this invention may be significantly reduced.

It is often desirable to temporarily lock open a well valve. Such temporary locking feature may be readily applied to the valve embodying the equalizing feature, described above.

The upper portion of the actuating sleeve 20 is provided with a plurality of peripherally spaced, radial slots 20*g* within which a plurality of radially shiftable locking segments 40 are respectively mounted. Segments 40 are continuously biased inwardly by a peripheral spring 41. The top surfaces of the locking segments 40 are provided with a re-entrant notch 40*a* which, in the temporary locked condition of the valve will be in engagement with the downwardly facing, inclined surface 10*e* provided in the interior wall of the upper housing 10. When the actuating sleeve 20 is moved longitudinally through the application of control fluid pressure to pressure chamber 29 in the manner heretofore described, the extreme downward position of the actuating sleeve 20 places the locking segments 40 in radial alignment with the annular recess 10*d* (FIG. 2B).

Figure 6A:
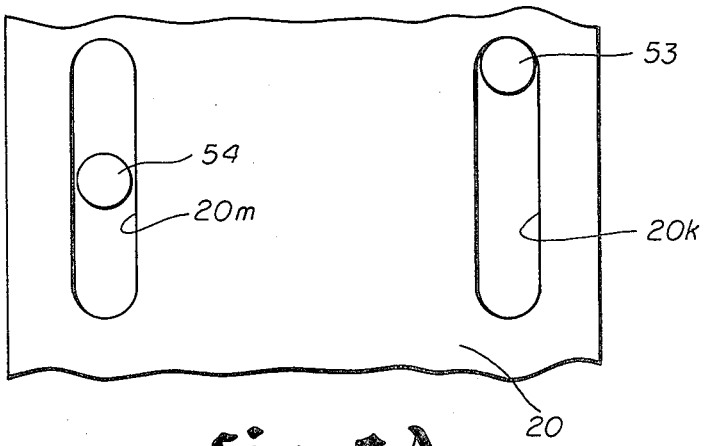
FIGS. 6A–6C are respectively schematic views illustrating the position of the pins relative to the slots which determine the limited movement of the locking sleeve with respect to the annular actuator.
Figure 6B:
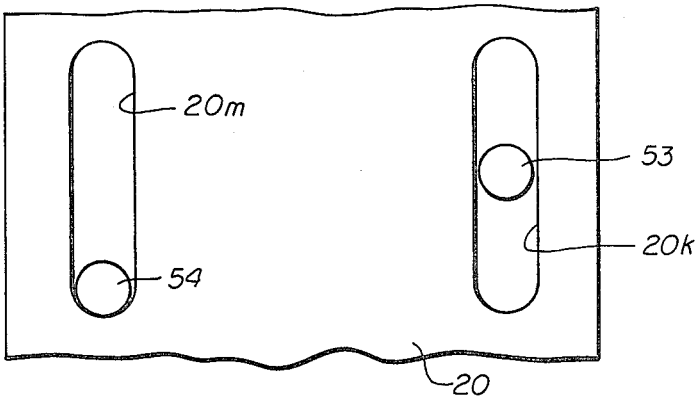
Figure 6C:
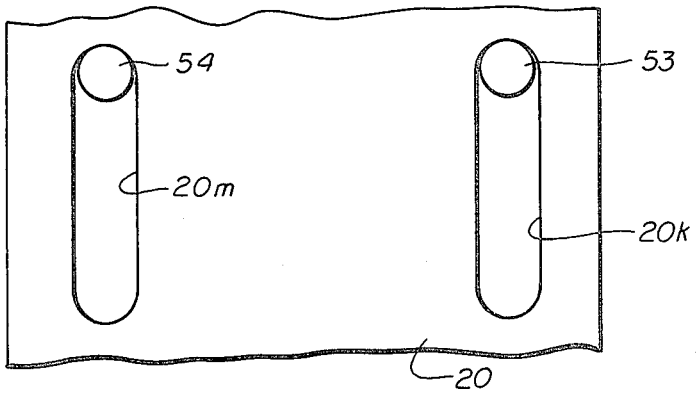

To effect the outward expansion of the locking segments 40 into the locking recess 10*d*, a locking sleeve 50 is provided which is axially slidable within the bore 20*f* of the upper portion of the actuating sleeve 20. The locking sleeve 50 is held in a normal position relative to the actuating sleeve 20 wherein a peripheral recess 51 in sleeve 50 having inclined upper and lower shoulders 51*a* and 51*b* is aligned with the inner ends of the locking segments 40. O-ring seals 42 and 43 are provided above and below the annular recess 51 to prevent leakage of control fluid through the locking segments 40. A Belleville spring 52 urges the locking sleeve upwardly relative to actuating sleeve 20 and its upward motion is restrained by a shearable pin 53 mounted in sleeve 50 which projects into an axially extending slot 20*k* provided in the wall of housing 20. A second slot 20*m* is provided on the diametrically opposite side of the actuating sleeve 20 to receive a non-shearable pin 54 also mounted in the sleeve 50, which, when locking sleeve 50 is in its aforedescribed normal position, is centrally positioned within the axial length of the slot 20*m* (FIG. 6A).

The locking sleeve 50 is further provided with an internal annular recess 55 suitable for engagement by a conventional expandable collet operable by an auxiliary conduit tool.

Figure 3A:
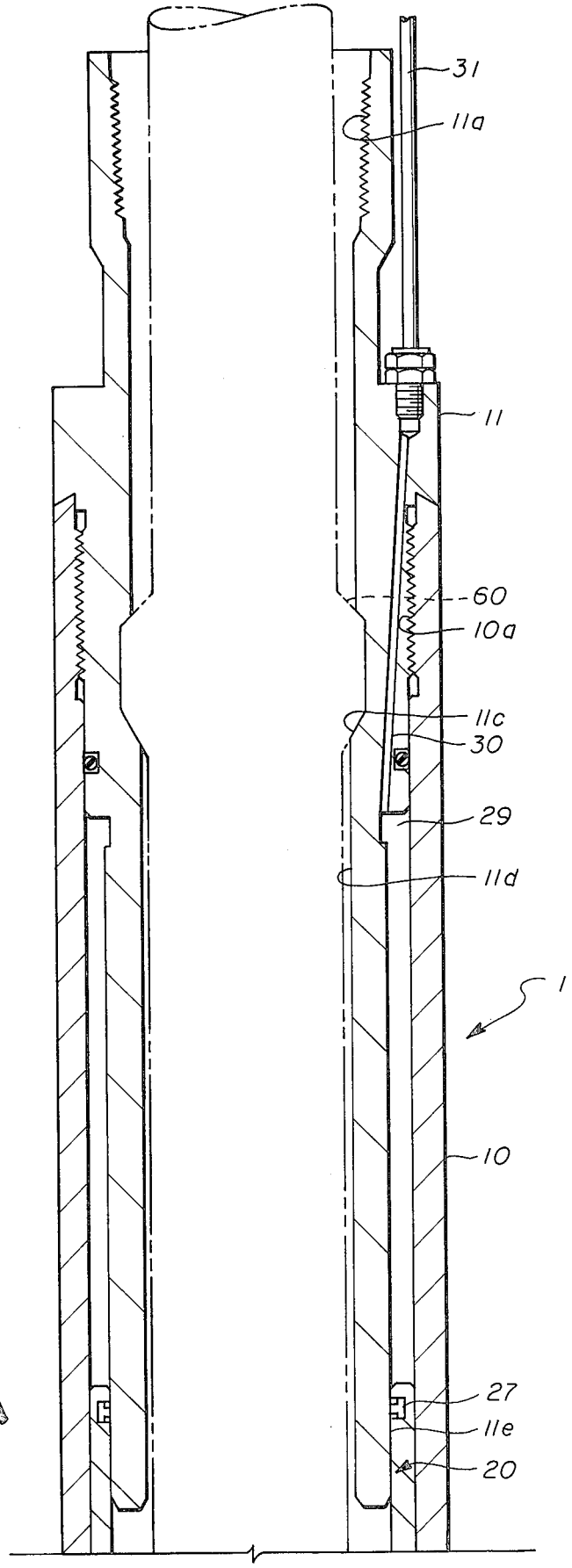
FIGS. 3A and 3B are views similar to FIGS. 2A and 2B and illustrate the locking sleeve shifted to its temporary locking position within the valve housing by auxiliary conduit means.
Figure 3B:
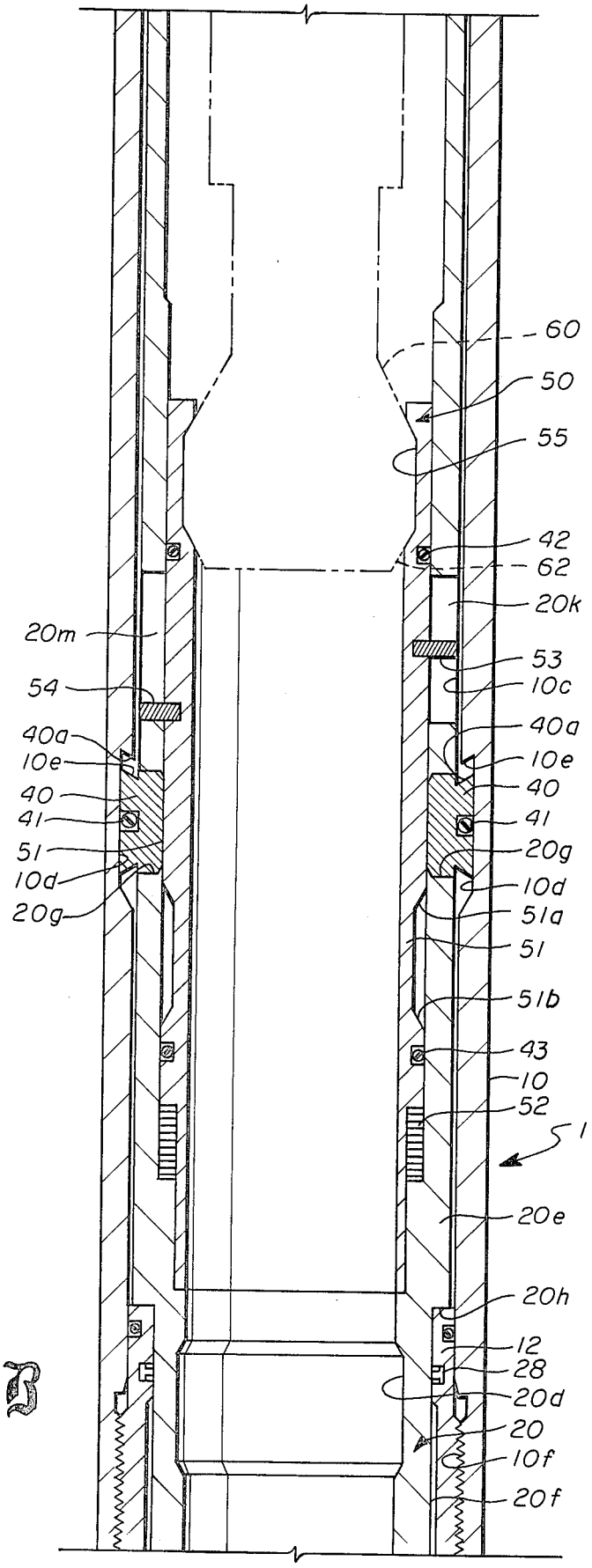

To effect the temporary locking of the actuating sleeve 20 in its lowermost valve opened position, control fluid pressure is first applied to the pressure chamber 29 to urge the actuating sleeve 20 downwardly to the position illustrated in FIGS. 2A–2D and effect the shifting of the valve body element or head 15 to its fully opened position. In this position, as previously mentioned, the locking segments 40 are disposed in radial alignment with the housing recess 10*d*. A tool 60, carried on an auxiliary conduit, such as wire line, indicated only schematically by dotted lines, is then seated on the landing shoulder 11*c* provided in the interior of the top sub 11 and in sealing engagement with the seal bore 11*d*, provided below the landing shoulder 11*c*. Then, as schematically illustrated in FIG. 3B, a conventional expansible collet 62 carried by the wire line tool 60 is expanded into engagement with the annular recess 55 provided at the top of the locking sleeve 50. The collet 62 is then manipulated to force the locking sleeve 50 downwardly, compressing the Belleville spring element 52 which opposes any downward relative movement of the locking sleeve 50 with respect to the actuating sleeve 20. Such downward movement produces an outward camming of the locking segments 40 by inclined shoulder 51*a* into engagement with the locking recess 10*d* provided in the inner wall of the housing 10. If the control pressure applied to the chamber 29 is now reduced, the actuating sleeve 20 will move upwardly and achieve a locked engagement between the inclined cooperating locking surface 10*e* provided on the housing 10 and the similarly inclined locking surface 40*a* provided on the upper surfaces of the locking segments 40. The engagement of the collet 62 with the locking sleeve 50 may now be disconnected and the locking sleeve 50 will move upwardly under the influence of the compressed Belleville spring 52 and retain the locking segments 40 in their radially outwardly displaced position. Thus the valve is mechanically locked in its open position.

To release the valve from the aforedescribed locked position, it is only necessary to reapply control pressure to the pressure chamber 29 to force the actuating sleeve 20 and hence locking segments 40 downwardly enough to disengage the inclined locking shoulders 40*a*. Upon such disengagement, the peripheral spring 41 will effect the radial retraction of such locking segments and, when control pressure is reduced, the actuating sleeve 20 is now free to move upwardly under the bias of the spring 21 to its normal inoperative position shown in FIGS. 1A–1D wherein the valve is closed.

The valve incorporates one further feature in that it may be permanently locked in an open position in the event that the safety valve needs repair, or alternatively, the seals 27 and 28 are no longer effective to develop sufficient control pressure to cause the downward actuation of the actuating sleeve 20.

If the seals 27 and 28 are still operable, the permanent locking of the safety valve in an open position may be achieved by first applying control pressure to the pressure chamber 29, thus moving the actuating sleeve 20 downwardly to position the safety valve body element 15 in its fully opened position. Concurrently, the locking segments 40 are disposed in radial alignment with the locking groove 10*d*. The tool 60 is then landed on the landing shoulder 11*c* and a conventional expandable collet 62 of the tool 60 is engaged with the annular recess 55 provided in the top end of the locking sleeve 50.

Figure 4A:
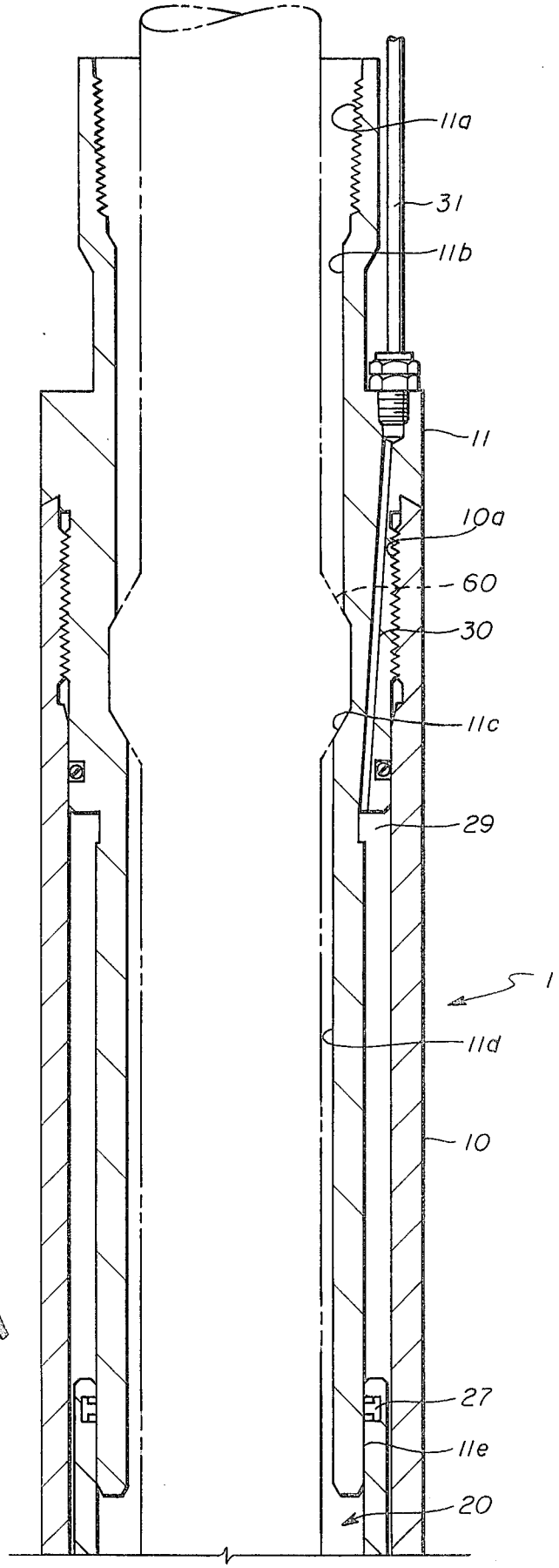
FIGS. 4A and 4B are views corresponding to FIGS. 3A and 3B, illustrating the position of the components of the valve when the locking sleeve is shifted to its permanent locking position.
Figure 4B:
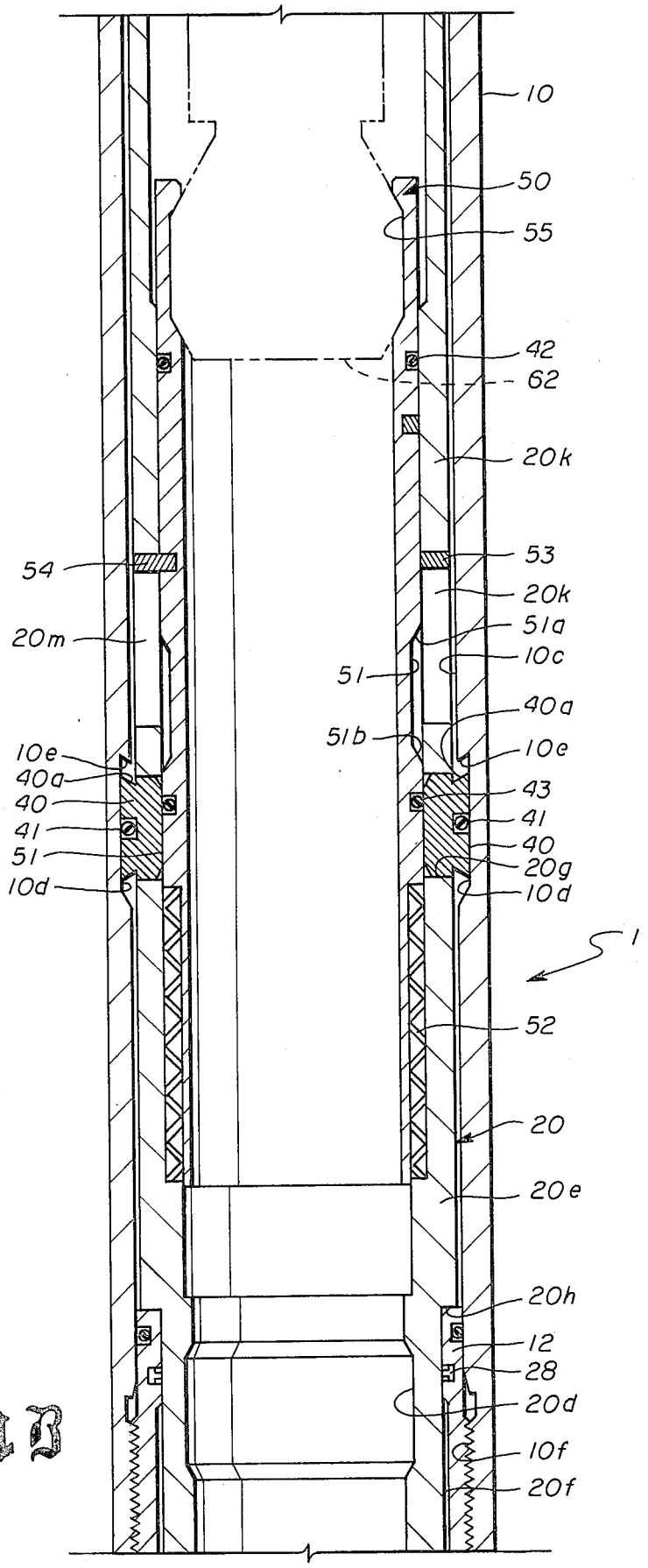

The line 62 collet is then manipulated to raise the locking sleeve 50 relative to the actuating sleeve 20 to the extent permitted by non shearable pin 54. This movement necessarily results in the shearing of the shearable pin 53 but, at the same time, effects the outward expansion of the locking segments 40 into locking engagement with the inclined locking shoulder 10*e* provided in the upper housing 10 (FIG. 4B). Moreover, the O-ring seal 43, which previously maintained the pressure integrity of the pressure chamber 29, is moved to a position overlying the locking segments 40, hence permitting leakage through such segments. Thus, it is no longer possible to apply a downward actuating pressure on the actuating sleeve 20 and effect disengagement of the inclined locking shoulders 40*a* and 10*e*. The safety valve is thus permanently locked in an open position.

Figure 5B:
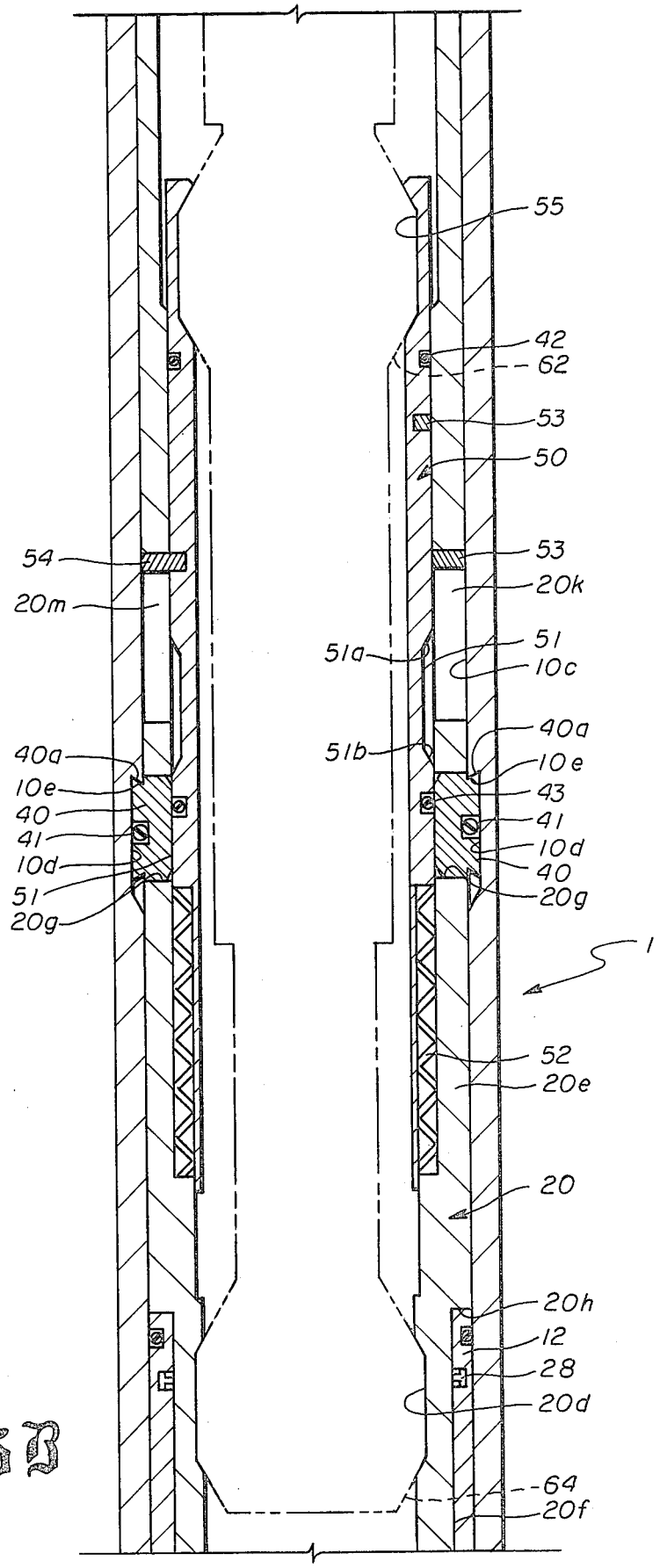
FIG. 5B is a view similar to FIG. 4B, showing permanent locking of the valve in open position when the hydraulic force on the actuating sleeve is ineffective.

In the event that the valve is to be permanently locked in an open position due to the failure of the hydraulic system or either of the seals 27 and 28, this may conveniently accomplished by actuation of both the actuating sleeve 20 and the locking sleeve 40 by an auxiliary conduit tool. The auxiliary conduit tool is again seated on the landing shoulder 11*c* provided in the top sub 11. A first conventional expandable collet 64 (FIG. 5B) is then engaged with the annular tool receiving recess 20*d* provided in the central portion of the actuating sleeve 20. Manipulation of the auxiliary conduit can then be employed to force the downward movement of the actuating sleeve to its open position relative to the valve body unit 15. A second expandable collet 62 is then engaged with the recess 55 in the locking sleeve 50 and the sleeve 50 is moved upwardly to shear the pin 53 and expand the locking segments 40 into locked engagement with the locking shoulder 10*e* in the upper housing 10. The valve is thus permanently locked in open position for removal from the well.

From the foregoing description, those skilled in the art will perceive many advantages of a valve incorporating the features of this invention. The actuation of the valve to an open position is accomplished with a minimum pressure force requirement due to the equalization of any pressure differential existing across the head of the valve. Moreover, the valve may be either temporarily locked in an open position or permanently locked in an opened position to facilitate well testing and/or removal of the valve from the well. In the open position of the valve, an unrestricted passage is provided for production fluid or for the lowering of other tools and/or instrumentation into the well.

Although the invention has been described in terms of specified embodiments which have been set forth in detail, it should be understood is not necessarily limited thereto. Alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a valve positionable within a subterranean well and having a housing defining an annular valve seat surrounding a longitudinally extending main fluid flow passage, a shiftable valve head movable to a closed position extending across the main fluid flow passage and sealably engaging said valve seat, whereby fluid pressure below said valve head will hold said valve head in said sealing engagement and movable to a second position at least substantially opening the main fluid flow passage, the improvement comprising: an actuator shiftably mounted within said housing and movable longitudinally within the main fluid flow passage; means for moving said actuator longitudinally to apply a force to said valve head in opposition to the fluid pressure thereon; said valve head having an aperture therethrough; a valve stem extending through said aperture; means on said valve stem for sealing said aperture by movement of said valve stem; resilient means mounted in said head for urging said valve stem to seal said aperture; and an enlarged portion secured to said valve stem and disposed in the longitudinal path of said actuator, whereby the initial longitudinal movement of said actuator shifts said valve stem in one direction to open said aperture to equalize fluid pressure above and below said valve head, followed by longitudinal movement of the actuator and valve head to open the main fluid flow passage when said aperture is open.

2. The improvement of claim 1 wherein said actuator is of annular configuration and is slidably mounted in said fluid flow passage, and said enlarged portion extends laterally into the longitudinal path of said annular actuator.

3. The improvement defined in claim 1 wherein said valve head is pivotally mounted for movement in a vertical plane about a horizontal axis between an open and a closed position relative to said valve seat.

4. The improvement of claim 3 wherein said actuator is of annular configuration and is slidably mounted in said fluid flow passage, and said enlarged portion extends diametrically into the longitudinal downward path of said annular actuator.

5. The improvement defined in claim 4 wherein said enlarged portion has its upper surface engaged by said actuator formed in a convex configuration to smoothly slide relative to the bottom surface of said annular actuator as said valve head is pivoted in one direction by longitudinal movement of said annular actuator.

6. The improvement defined in claim 4 or 5 wherein said resilient means comprises a pair of biasing members disposed in vertically aligned recesses in said valve head and said diametrically enlarged portion of the valve stem.

7. In a valve adaptable for positioning within a subterranean well on a well flow conduit and having a housing defining an annular valve seat surrounding a fluid flow passage in said conduit, a shiftable valve head sealably engaging said valve seat, the improvement comprising: an annular actuator shiftably mounted within said housing; means for moving said actuator in one direction to apply a force to said valve head; resilient means opposing the movement of said annular actuator in said one direction; and locking means having a sleeve manipulated by an auxiliary conduit and slidable within said annular actuator for locking said annular actuator in its valve open position; said locking means comprising: radially shiftable locking means disposed in the wall of said annular actuator; resilient means normally retaining said radially shiftable locking means in a radially retracted position; said housing having a shoulder alignable with said locking means when said annular actuator is moved in one direction to valve opening position; a locking sleeve mounted within said annular actuator for limited axial movement; said locking sleeve having a peripheral camming shoulder thereon engagable with said radially retracted locking means to cam said locking means to engage said facing shoulder; and auxiliary conduit connection means on said locking sleeve to permit said locking sleeve to be axially shifted by manipulation of the auxiliary conduit to temporarily lock said annular actuator and said valve head in said open position.

8. The improvement defined in claim 7 wherein said radially shiftable locking means comprises a plurality of identical segments respectively slidable in a peripheral array of radial apertures in the wall of said annular actuator, said locking sleeve having an external annular recess normally receiving the inner ends of said segments, one end surface of said recess constituting said peripheral camming shoulder to urge said segments to engage said shoulder on said housing when said control sleeve is axially shifted by manipulation of the auxiliary conduit.

9. In a subterranean well valve having a housing defining an annular valve seat surrounding a main fluid flow passage, a shiftable valve head movable to a closed position extending across the fluid flow passage and sealably engaging said valve seat, whereby fluid pressure below said valve head will hold said valve head in said sealing engagement, the improvement comprising: an annular actuator slidably mounted in said main fluid flow passage and movable in one direction through said annular valve seat to shift said valve head to an open position relative to said annular valve seat; means for applying fluid pressure to the upper end face of said annular actuator to urge said actuator in one direction to open said valve head; resilient means opposing movement of said actuator in said one direction; radially shiftable locking means disposed in the wall of said annular actuator; resilient means normally retaining said radially shiftable locking means in a radially retracted position; said housing having a shoulder alignable with said locking means when said annular actuator is moved in one direction to its said valve opening position; a locking sleeve mounted within said annular actuator for limited axial movement; said locking sleeve having a peripheral camming shoulder thereon engagable with said radially retracted locking means to cam said locking means to engage said shoulder; and auxiliary conduit connection means on said locking sleeve to permit said locking sleeve to be axially shifted by manipulation of the auxiliary conduit line to temporarily lock said annular actuator and said valve head in said open position.

10. The improvement of claim 9 wherein said radially shiftable locking means comprises a plurality of identical segments respectively slidable in a peripheral array of radial apertures in the wall of said annular actuator, said locking sleeve having an external annular recess normally receiving the inner ends of said segments, one end surface of said recess constituting said peripheral camming shoulder to urge said segments radially outward to engage beneath said shoulder on said housing when said control sleeve is axially shifted by manipulation of the auxiliary conduit.

11. The improvement of claim 10 wherein the limited axial movement of said locking sleeve relative to said annular actuator is determined by a first pin and slot means and a spring disposed between said locking sleeve and said annular actuator holding said locking ring recess in axial alignment with said locking segments against the bias of said spring urging said locking sleeve in one direction, said first pin and slot means including a pin shearable by manipulation of said locking sleeve, whereby the temporary locking of said annular actuator in its valve opening position may be made permanent by shearing said pin of said first pin and slot means to permit said locking sleeve to shift and permanently hold said locking segments in their locking positions.

12. The improvement of claim 11 further comprising a second non-shearable pin and slot means operating between said annular actuator and said locking sleeve to limit movement of said locking sleeve to that required for permanent locking of the annular actuator in its valve open position.

13. The improvement defined in claim 8, 9 or 11 wherein the abutting surfaces of said locking means and said shoulder in their engaged position are downwardly and inwardly inclined, whereby an initial downward movement of said annular actuator is required to permit retraction of said locking means to an unlocked position.

14. In a valve positionable within a subterranean well and having a housing defining an annular valve seat surrounding a main fluid flow passage, a shiftable valve head movable to a closed position extending across the main fluid flow passage and sealably engaging said valve seat, whereby fluid pressure below said valve head will hold said valve head in said sealing engagement, the improvement comprising: an acutator shiftably mounted within said housing; means for moving said actuator longitudinally to apply a force to said valve head in opposition to the fluid pressure thereon; said valve head having an aperture therethrough; a valve stem extending through said aperture; means on said valve stem for sealing said aperture by movement of said valve stem; resilient means mounted in said valve head for urging said valve stem to seal said aperture; an enlarged portion secured to said valve stem and disposed in the longitudinal path of said actuator, whereby the initial longitudinal movement of said actuator shift said valve stem in one direction to open said aperture to equalize fluid pressure above and below said valve head, followed by longitudinal movement of the actuator and valve head to open the main fluid flow passage; radially shiftable locking means disposed in the wall of said annular actuator; resilient means normally retaining said radially shiftable locking means in a radially retracted position; said housing have a shoulder alignable with said locking means when said annular actuator is moved in one direction to valve opening position; a locking sleeve mounted within said annular actuator for limited axial movement; said locking sleeve having a peripheral camming shoulder thereon engagable with said radially retracted locking means to cam said locking means to engage said facing shoulder; and auxiliary conduit connection means on said locking sleeve to permit said locking sleeve to be axially shifted by manipulation of the auxiliary conduit to temporarily lock the said annular actuator and said valve head in said open position.

15. The improvement of claim 14 wherein said radially shiftable locking means comprises a plurality of identical segments respectively slidable in a peripheral array of radial apertures in the wall of said annular actuator, said locking sleeve having an external annular recess normally receiving the inner ends of said segments, one end surface of said recess constituting said peripheral camming shoulder to urge said segments radially outward to engage beneath said shoulder on said housing when said control sleeve is axially shifted by manipulation of the auxiliary conduit.

16. The improvement of claim 15 wherein the limited axial movement of said locking sleeve relative to said annular actuator is determined by a first pin and slot means and a spring disposed between said locking sleeve and said annular actuator holding said locking ring recess in axial alignment with said locking sleeve in one direction, said first pin and slot means including a pin shearable by manipulation of said locking sleeve, whereby the temporary locking of said annular actuator in its valve opening position may be made permanent by shearing said pin of said first pin and slot means to permit said locking sleeve to shift and permanently hold said locking segments in their locking positions.

17. The improvement of claim 16 further comprising a second non-shearable pin and slot means operating between said annular actuator and said locking sleeve to limit movement of said locking sleeve to that required for permanent locking of the annular actuator in its valve open position.

18. In a valve positionable within a subterranean well and having a housing defining an annular valve seat surrounding a longitudinally extending main fluid flow passage, a shiftable flapper valve head pivotally mounted on the valve housing and movable to a closed position extending across the main fluid flow passage and sealably engaging said valve seat, the improvement comprising:

an annular actuator shiftably mounted within said housing and longitudinally movable within the main fluid flow passage;

means for moving said actuator longitudinally to shift said flapper valve head to open the main fluid flow passage;

first resilient means for biasing the flapper valve relative to the housing to the closed position;

an aperture extending longitudinally through said flapper valve head;

pressure differential equalizing valve means extending through said aperture and longitudinally shiftable relative to said flapper from a first position to a second position for opening a pressure differential equalizing flow path through the flapper valve head;

second resilient means for biasing said equalizing valve means relative to said flapper valve head to said first position; and means on the equalizing valve means extending above said flapper valve head for engaging the actuator prior to longitudinal movement of said actuator for shifting said flapper valve head, said actuator shifting the equalizing valve to said second position to equalize fluid pressure above and below said flapper valve head, the flapper valve head being shiftable to open the main flow passage upon additional longitudinal movement of the actuator when the equalizing valve means is in the second position.

19. The improvement of claim 1 wherein the upper end of said housing is mounted on the end of a production conduit extending thereabove and the lower end of said housing is mounted to a production conduit extending therebelow.

20. In a valve positionable within a subterranean well and having a housing defining an annular valve seat surrounding a longitudinally extending main fluid flow passage, a shiftable flapper valve head pivotally mounted on the valve housing and movable to a closed position extending across the main fluid flow passage and sealably engaging said valve seat, whereby fluid pressure below said valve head will hold said valve head in said sealing engagement and movable to a second position at least substantially opening the main fluid flow passage, first resilient means for biasing the flapper valve relative to the housing to the closed position; the improvement comprising: an actuator shiftably mounted within said housing and movable longitudinally within the main fluid flow passage; means for moving said actuator longitudinally to apply a force to said valve head in opposition to the fluid pressure thereon; said valve head having an aperture therethrough; a valve stem extending through said aperture; means on said valve stem for sealing said aperture by movement of said valve stem; second resilient means mounted in said head for urging said valve stem to seal said aperture; and an enlarged portion secured to said valve stem and disposed in the longitudinal path of said actuator, to engage the end of said actuator whereby the initial longitudinal movement of said actuator shifts said valve stem in one direction to open said aperture to equalize fluid pressure above and below said valve head, followed by longitudinal movement of the actuator and valve head to open the main fluid flow passage when said aperture is open.

* * * * *